US007900313B2

(12) United States Patent
Wren et al.

(10) Patent No.: US 7,900,313 B2
(45) Date of Patent: Mar. 8, 2011

(54) COATING CONTAINER, KIT AND COATING COMBINATION

(75) Inventors: Gary Thomas Wren, Ashford (GB); John David Lamb, Pewsey (GB); Johanna Barbara Tarkowski, Marlborough (GB); Michael Lewkowicz, Southampton (GB); Jillian Margaret Prebble, Crondall (GB)

(73) Assignee: Imperial Chemical Industries Limited, London ( * ) Notice: Subject to any disclaimer, the term of this patent is extended or adjusted under 35 U.S.C. 154(b) by 1150 days.

(21) Appl. No.: 11/137,223

(22) Filed: May 25, 2005

(65) Prior Publication Data

US 2006/0000046 A1 Jan. 5, 2006

Related U.S. Application Data

(63) Continuation-in-part of application No. PCT/EP2005/005750, filed on May 25, 2005.

(30) Foreign Application Priority Data

Jun. 8, 2004 (GB) ..... 0412711.4
Dec. 21, 2004 (GB) ..... 0427909.7

(51) Int. Cl.
*B44D 3/12* (2006.01)

(52) U.S. Cl. ..... 15/257.06

(58) Field of Classification Search ..... 15/257.06, 15/257.05; 524/497, 445, 447, 425–427
See application file for complete search history.

(56) References Cited

U.S. PATENT DOCUMENTS 2,698,450 A 1/1955 Mack
3,044,096 A 7/1962 Englehard
4,304,693 A 12/1981 Boberski et al.
4,566,148 A * 1/1986 Rolin ..... 15/257.05

(Continued)

FOREIGN PATENT DOCUMENTS

DE 10 23 704 B 1/1958

(Continued)

OTHER PUBLICATIONS

"Ropak Packaging Home Page", Ropak Packaging, Fullerton, CA, 2002, www.ropakcorp.com/lpg/lpacpub01.nsf/Content/RPK_Ropak_Homepage; 1 pg.

(Continued)

*Primary Examiner* — Laura C Guidotti
(74) *Attorney, Agent, or Firm* — George W. Moxon, II; Moxon & Associates

(57) ABSTRACT

A coating combination suitable for use in coating architectural surfaces which comprises in combination a lidable container, a coating composition provided within the lidable container, and a buoyant coating contacting member (4) including at least one aperture disposed substantially horizontally within the lidable container. The buoyant coating contacting member has physical properties selected from at least one of shape, density, number of apertures, and total area of apertures such that the buoyant coating contacting member is buoyant on the coating composition and submersible within the coating composition to the extent that under a downwards force from a coating applicator, a portion of the coating composition is allowed to flow through the at least one aperture such that the coating applicator can pick up the coating composition. When the combination has a lid, the lid is removed for insertion of the applicator for the exertion of downward pressure.

26 Claims, 3 Drawing Sheets

U.S. PATENT DOCUMENTS

| | | | | |
|---|---|---|---|---|
| 4,651,379 | A | 3/1987 | Kern | |
| 5,085,317 | A | 2/1992 | Jensen et al. | |
| 5,123,576 | A | 6/1992 | Lawrence | |
| 5,283,928 | A | 2/1994 | Linn et al. | |
| 5,303,839 | A | 4/1994 | Blumenschein | |
| 5,546,628 | A | 8/1996 | Silvera | |
| 5,746,345 | A | 5/1998 | Zurawin | |
| 5,975,346 | A | 11/1999 | Imperato et al. | |
| 6,384,132 | B1 * | 5/2002 | Horley et al. | 524/842 |
| 6,479,573 | B2 * | 11/2002 | Burdick et al. | 524/394 |
| 6,772,471 | B1 | 8/2004 | Rossouw | |
| D518,265 | S | 3/2006 | Prokop et al. | |
| D524,003 | S | 6/2006 | Prokop et al. | |
| D524,501 | S | 7/2006 | Prokop et al. | |
| 2002/0151643 | A1 * | 10/2002 | Sarkar et al. | 524/515 |
| 2004/0226958 | A1 | 11/2004 | Robellard et al. | |
| 2005/0189354 | A1 | 9/2005 | Heather et al. | |

FOREIGN PATENT DOCUMENTS

| | | | |
|---|---|---|---|
| DE | 10 39 419 | B | 9/1958 |
| DE | 1816255 | U | 8/1960 |
| DE | 2140189 | A1 | 2/1973 |
| DE | 2544990 | A1 | 4/1977 |
| DE | 8502960 | U1 | 5/1985 |
| DE | 8513250 | U1 | 6/1985 |
| DE | 20011439 | U1 | 10/2000 |
| DK | 9500101 | A1 | 4/1996 |
| EP | 0115249 | A1 | 8/1984 |
| EP | 0 144 135 | A | 6/1985 |
| EP | 0 151 876 | A | 8/1985 |
| EP | 0341916 | A2 | 11/1989 |
| EP | 1702855 | A2 | 9/2006 |
| FR | 2087688 | A5 | 12/1971 |
| FR | 2299167 | A1 | 8/1976 |
| FR | 2705281 | A1 | 11/1994 |
| FR | 2725696 | A1 | 4/1996 |
| GB | 274542 | A | 7/1927 |
| GB | 616926 | A | 1/1949 |
| GB | 2255309 | A | 11/1992 |
| WO | WO9936189 | A1 | 7/1999 |
| WO | WO 00/47338 | A | 8/2000 |
| WO | WO0151190 | A1 | 7/2001 |
| WO | WO03024725 | A1 | 3/2003 |
| WO | WO03031041 | A1 | 4/2003 |
| WO | WO2005120864 | A3 | 12/2005 |
| WO | WO2006061019 | A2 | 6/2006 |
| WO | WO2008084328 | A1 | 7/2008 |

OTHER PUBLICATIONS

"Square Containers" datasheet, Ropak Packaging, Fullerton, CA, 2002, www.ropakcorp.com/lpg/lpacpub01.nsf/Content/rpk_product_type2; 1 pg.

"2.1-Gallon Square Container (S026)" datasheet. Ropak Packaging, Fullerton, CA, 2002, www.ropakcorp.com/lpg/lpacpub01.nsf/Content/rpk_square_S026; 1 pg.

"2.1-Gallon Square Container (SA26)" datasheet. Ropak Packaging, Fullerton, CA, 2002, www.ropakcorp.com/lpg/lpacpub01.nsf/Content/rpk_square_SA26; 1 pg.

"EZ Stor Containers" datasheet, Ropak Packaging, Fullerton, CA, 2002, www.ropakcorp.com/lpg/lpacpub01.nsf/Content/rpk_product_type3; 1 pg.

"1-Gallon EZ Stor Container (E015)" datasheet. Ropak Packaging, Fullerton, CA, 2002, www.ropakcorp.com/lpg/lpacpub01.nsf/Content/rpk_EZStor_E015; 1 pg.

"2-Gallon EZ Stor Container" datasheet. Ropak Packaging, Fullerton, CA, 2002, www.ropakcorp.com/lpg/lpacpub01.nsf/Content/rpk_EZStor_E027; 1 pg.

"3-Gallon EZ Stor Container" datasheet. Ropak Packaging, Fullerton, CA, 2002, www.ropakcorp.com/lpg/lpacpub01.nsf/Content/rpk_EZStor_E037; 1 pg.

"Cuprinol Rollable Shed & Fence Treatment", 10 pages, (available approximately Feb. 2002).

Spreepatent, Offer for Licensing/Production/Distribution, Aug. 10, 2003.

Dutch Boy "Ready to Roll" Pressroom, http://pressroom.dutchboy.com/images/welcome_r2r.jpg and press release, Jul. 2004.

Dutch Boy "Ready to Roll" product, 2 pages (published at least as early as Aug. 26, 2004).

* cited by examiner

COATING CONTAINER, KIT AND COATING COMBINATION

CROSS-REFERENCE TO RELATED APPLICATIONS

This application is a continuation-in-part (CIP) of copending PCT international application filed the same day as this application entitled "Coating Combination" with the Serial No. PCT/EP05/05750 filed May 25, 2005, and as does application PCT/EP05/05750 claim the benefit of priority to United Kingdom Patent Application No. 041271114 entitled, "Roller Coating Architectural Surface", filed Jun. 8, 2004 and United Kingdom Patent Application No. 0427909.7, entitled "A Coating Combination" filed on Dec. 21, 2004. The disclosure of all of these applications is hereby incorporated by reference.

BACKGROUND OF THE INVENTION

The present disclosure relates to a coating combination suitable for coating an architectural surface. The present disclosure also relates to a buoyant coating contacting member for use with such a coating combination. The present disclosure further relates to a container for the coating which with the coating comprises a kit.

Typically the coating combination includes a coating composition which is applied by amateur (i.e. "do-it-yourself" or "DIY") coaters wanting to coat an architectural surface as quickly as possible. Architectural surfaces include for example the surfaces of walls, ceilings or doors as found on and in buildings and particularly as found in domestic dwellings. Roller coating is quicker than brush coating for most if not all of the typical 1 coating compositions including paints, varnishes, lacquers, wall covering pastes and fillers such as the plaster compositions used to fill cracks or holes. Paints are the coating compositions most frequently applied by amateurs and so this description will refer primarily to paints even though similar considerations will apply to other coating compositions. Paints are coating compositions that typically comprise at least a binder, pigment, and carrier. For instance a latex paint typically has at least an aqueous emulsion or dispersion of a polymer with reduced water solubility, a pigment, a pigment dispersant, and water as the primary carrier. A latex is usually an emulsion or dispersion of one or more water insoluble polymers in water. One type of paint that can further simplify the painting process for the amateur and contractor alike is the paint that in one coat gives desired coverage along with other paint film properties and saves any time used in applying a conventional second coat.

Painting using a roller is from 2 to 6 times faster than painting using a brush and it requires less skill as is reported by A H Beckly on pages 143 to 150 of his "Handbook of Painting and Decorating Products" published in 1983 by Granada of London, see in particular pages 148 and 150. The contents of pages 143 to 150 and Plate 14 (referred to later) of Beckly are herein incorporated by reference. Rollers also make the painting of rough surfaces easier and therefore quicker yet despite their advantages, many amateurs are reluctant to use them because of their potential for creating mess if used unskillfully. Therefore it is important to minimise the risks of mess to make the use of rollers more attractive to amateurs and providing ease of use for the contractor or professional painter. Further benefits can be gained by reducing the risks of mess in the use of rollers while also harnessing the characteristics which produce mess as the very characteristics which enable a paint to give adequate one-coat cover of marks on a surface.

To achieve adequate one-coat coating, it is necessary to apply a coat of paint which is thicker than is normally possible using popular paints. The problem with popular conventional paints is that if they are applied as a thick coat to a vertical surface such as the surface of a wall or door, they will begin to flow downwards before the paint has had time to dry and unsightly marks known as "sagging" will appear. Sagging is illustrated in Plate 14 of Beckly. The sagging problem is aggravated in one-coat paints by the fact that it is usually necessary for the paint to contain higher than usual levels of rutile titanium dioxide opacifying pigment. Rutile has a density of 4.05 kg/l and so it substantially increases the density of the paint and hence its tendency to sag.

Current commercially available one-coat paints avoid the problem of sagging by increasing the viscosity of the paints. Unfortunately, increasing the viscosity also increases the risk of mess because of the ways in which paint is conventionally loaded onto a roller. In one particular commercial practice, loading is performed from a tray provided with a well and an adjacent ribbed surface (see Beckly, page 150) which slopes gently downwards towards the well. The first step in the loading procedure is to pour paint into the well from the can or bucket in which it has been supplied by the manufacturer. Spilling during this pouring step is a potential source of mess when performed by unskilled amateurs especially if the paint is highly viscous because there is a risk of it flowing in a sudden rush. The next step is to load the roller by dipping it into the filled well whereupon it inevitably picks up more paint than can be cleanly applied to a surface. This means that the excess paint has to be; removed which is done by rolling the roller over the sloping ribbed surface. Popular paints have low viscosities which allow the excess paint to flow back down the slope and into the well but if the viscosity is too high, the paint will cling to the ribbed surface where it becomes a source of mess.

Another commercial practice for loading a roller comprises the use of a combination of a bucket filled with paint and a separate grid which is held manually over a full opened bucket or is removably latched onto the rim of a partially full opened bucket as shown for example in U.S. Pat. No. 5,283,928 issued in 1994. When a bucket and grid combination are used, the roller is loaded by dipping it into paint contained in the bucket whereupon as before it picks up excess paint which this time is removed by rolling the roller up and down the grid whilst the grid is positioned more or less vertically above the paint with its lower edge dipping into the paint. Irrespective of the viscosity of the paint, removal of excess paint in this way creates a messy grid and the mess is greater if the paint is highly viscous. A messy grid is more hazardous than a messy ribbed surface of a tray because the grid is not permanently attached to the bucket and so there is a risk of it being set down in the wrong place by a tiring absent-minded amateur.

The need to use a ribbed surface or a vertical grid can be avoided by supplying the paint in a tray as a solid composition having a shear-sensitive structure which enables a top shallow layer of the composition to break down and liquefy when a roller is rolled across it. The supply of such solid paints in a tray is described in U.S. Pat. No. 4,304,693 published in 1981 or in European Patent Application EP 0 144 134A published in 1985. The fact that only a shallow top layer of the solid paint liquefies ensures that only a limited amount of paint can be picked up by the roller and so there is no need to remove excess paint using a ribbed surface or a vertical grid. However, the limitation on the amount of paint which can be picked up by the roller prevents the roller from loading quickly with enough paint for the application of a coating which is thick enough to give adequate one-coat cover or even cover using conventional (less viscous) coating compositions if the surface is badly marked.

European Patent Application EP 0 151 876A published in 1985 describes an alternative technique for avoiding the need to use a ribbed surface or vertical grid. The technique comprises supplying "popular forms of paint" in a tray and providing an open structured grid in which the apertures of the grid occupy over 70% of the area of the underneath area of the grid. The grid is made of for example polyvinyl chloride or "PVC" and it lies horizontally on the surface of the paint. The density of PVC is about 1.4 kg/l which is also about the upper limit of the density of popular paints so the surface tension and viscosity of a popular paint must be important amongst the forces which support the grid on the surface and prevent it from submerging into the paint. A roller can be loaded with paint from the tray by rolling it lightly across the grid as it lies horizontally on the surface of the paint. Once again only a limited amount of paint is picked up by the roller so avoiding the need for a messy removal of excess paint from the roller. But also once again, the limited amount of paint picked up is insufficient to provide conventional cover over a badly marked surface certainly not a coating which is thick enough to give adequate one-coat cover. The loading of paint onto the roller could in theory be increased by pressing the roller down harder onto the grid but such pressure causes the grid to submerge irretrievably into the paint allowing the roller to overload with no available means for removing excess paint. These problems have hitherto not been overcome even when successful commercially available one-coat paints have been tried as an alternative to the popular paint supplied in the tray as described above. An example of such a one-coat paint is "Crown" "Solo" which is currently supplied in a can for application by brush as described in European Patent EP 0 341 916B published in 1994. Another example is "Dulux" "Qantum" (sic) which is a one-coat paint described for application by roller but only when loaded from a traditional combination of bucket and vertical grid as described in the leaflet "Die Neue Streichweite" published by ICI Lacke Farbe GmbH in the late 1990's.

SUMMARY OF THE INVENTION

In one aspect, the disclosure provides a roller coating surface and coating container all in one kit which can have any type of fluid coating composition for ease of application by both amateurs and professional painting contractors alike. Another aspect of the disclosure provides a coating combination suitable for use by amateurs as well as contractors wanting to apply a coating composition quickly. Further when used with a coating composition of appropriate viscosity, such a combination can give adequate one-coat cover without creating the traditional risks of mess. A further aspect of the disclosure provides a roller contacting member for use with the containers, coatings, kits and combinations.

Thus, according to one embodiment of the present invention there is provided a coating combination suitable for use in coating architectural surfaces which comprises in combination a lidable container for a coating composition, a coating composition provided within the lidable container, and a buoyant coating contacting member (4) including at least one aperture disposed substantially horizontally within the lidable container, wherein the buoyant coating contacting member has physical properties selected from at least one of shape, density, number of apertures, and total area of apertures such that the buoyant coating contacting member is buoyant on the coating composition and submersible within the coating composition to the extent that under a downwards force from a coating applicator, a portion of the coating composition is allowed to flow through the at least one aperture such that the coating applicator can pick up the coating composition. With the lid on the container, the lid is removed to apply the downward force.

This allows a user of the coating applicator, for example, a roller, to exert a downwards pressure on the buoyant coating contacting member via the roller resulting in a flow of coating composition through the one or more apertures of the coating contacting member which in turn allows the roller to be sufficiently loaded without the coating contacting member sinking. In the case of a one coat coating composition, the loading of the composition on the roller is sufficient to achieve adequate one-coat cover. In addition, if the user of the roller senses that it is beginning to overload, the user can produce a quick corrective response by reducing the pressure from the roller whereupon the coating contacting member responds with a quick upwards movement causing a quick fall in hydraulic pressure and a consequential quick reduction in the supply of coating composition to the roller.

According to another aspect of the present invention there is provided a buoyant coating contacting member including at least one aperture for disposition substantially horizontally within a lidable container containing a coating composition, wherein the buoyant coating contacting member has physical properties selected from at least one of shape, density, number of apertures, and total area of apertures such that the buoyant coating contacting member is buoyant on the coating composition when lying substantially horizontal, and submersible within the coating composition to the extent that under a downwards force from a coating applicator, a portion of the coating composition is allowed to flow through the at least one aperture such that the coating applicator can pick up the coating composition.

BRIEF DESCRIPTION OF THE DRAWINGS

The present invention will now be illustrated by the following preferred embodiment described with reference to the drawings in which.

DETAILED DESCRIPTION OF THE INVENTION

Figure 1:
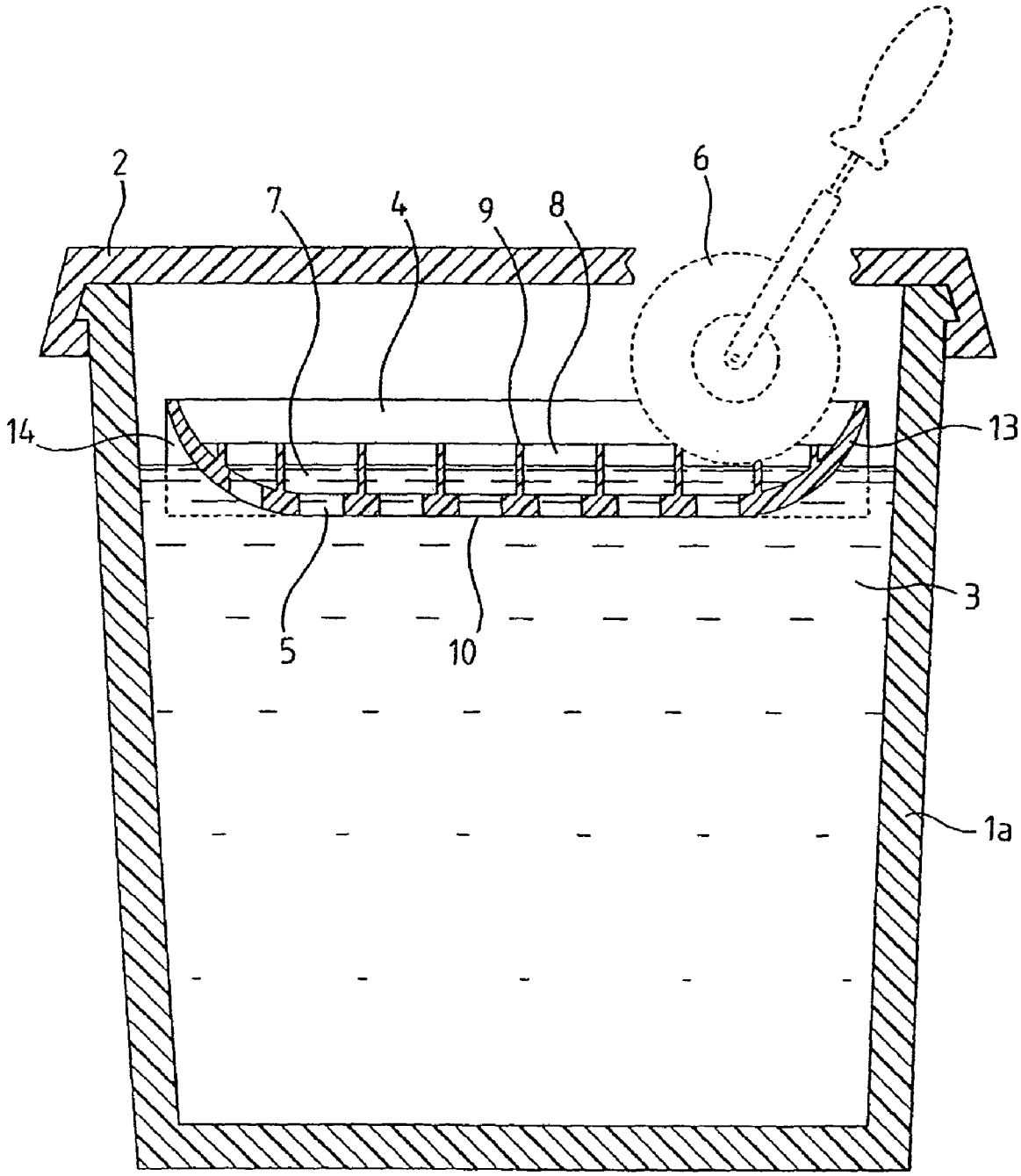
FIG. 1 is a diagrammatic section through a lidable container containing paint and buoyant coating contacting member according to the present invention.

Other than in the operating examples, or where otherwise indicated, all numbers expressing quantities of ingredients, reaction conditions, and ranges of various properties both physical and chemical used herein are to be understood as modified in all instances by the term "about".

As used herein the term "substantially horizontal" primarily refers to the buoyant coating contacting member positioned on and in (near the surface) of the fluid, gel, or liquid coating composition present as the coating composition in the container where the underneath area is the part of the contacting member facing the fluid, gel, or liquid coating. The substantial horizontal position may rock, tilt, or pitch when a roller is loaded with coating composition from or sits on the contact member.

Preferably the coating composition has a high shear viscosity (e.g. an ICI Cone and Plate viscosity) at 25° C. of from 0.1 to 0.3 (preferably 0.17 to 0.25) pascal.sec, and a low shear viscosity (e.g. a Sheen Rotothinner viscosity) at 25° C. of from 0.05 to 3.5 (preferably 0.3 to 3.5, more preferably 1.0 to 2.0) pascal.sec. Alternatively, other coatings can be used for instance those which have a high shear viscosity (e.g. ICI Cone and Plate viscosity) somewhere in the range from 0.2 to 2, more appropriately somewhere in the range from 0.5 to 1.5 and also those somewhere in the range of from 0.8 to 1.2 Pascal-seconds while also having a low shear viscosity somewhere in the range of 80 to 110 Kreb units. Krebs units ("KU") are for Stormer viscosity which is measured according to ASTM D662-81. As mentioned infra these coatings that may utilize changes in the buoyant coating contacting member is regards to aperture area, number or shape of apertures, density or shape of the member or any combination of two or more of these.

Preferably, the physical properties of the buoyant coating contacting member enables it to experience a hydraulic upthrust which is greater than the hydraulic upthrust which would be experienced by a notional planar buoyant coating contacting member made of the same material when under the same downwards pressure and having the same horizontal dimensions as the buoyant coating contacting member but having an average thickness of 1 mm and having apertures which cover 70% of the underneath area of the notional buoyant coating contacting member.

Preferably, the coating composition is a one coat coating composition.

Preferably, the buoyant coating contacting member experiences a hydraulic upthrust which is at least three times (and more preferably at least five times) greater than that which would be experienced by the notional buoyant coating contacting member.

Preferably the buoyant coating contacting member is in the form of a tray or grid having a plurality of apertures.

The increased hydraulic upthrust allows a user of the coating applicator, for example, a roller, to exert a greater downwards pressure on the buoyant coating contacting member via the roller resulting in a greater flow of coating composition through the apertures of the coating contacting member which in turn allows the roller to be sufficiently loaded without the coating contacting member sinking.

An effective way to increase the upthrust on the buoyant coating contacting member is to shape it so that the proportion of the underneath area which is covered by the apertures, i.e. the total aperture area, is as low as is commensurate with an adequate loading of the roller, i.e. the roller can be loaded without the buoyant coating contacting member sinking. Preferably, the total aperture area is less than 70%, preferably less than 60%, more preferably less than 50%, and even more preferably less than 40% of the underneath area (10) of the buoyant coating contacting member. This means that the hydraulic pressure has a large area of solid surface against which to react and so impart a much greater upthrust than would experienced by the notional buoyant coating contacting member. For the fluid, gel, or coating compositions on which the buoyant coating member is substantially horizontally positioned in the container or kit that have a viscosity less than the suitable one-coat paint compositions the total aperture area can be as lower than 10% and even lower than 6%.

Preferably the apertures should have an individual cross-sectional area of from 40 to 150 $mm^2$ with 65 to 100 $mm^2$ being preferred. The apertures may be any convenient shape such as elliptical slots or slits but circular, rectangular or rhomboidal shapes are preferred. They may be of the same or mixed shapes and sizes. The size and shape and the low shear viscosity of the coating composition all interact to govern the ease with which coating composition passes through the buoyant coating contacting member and onto the roller. The nature of this interaction is too complex to be specified and so the optimum size and shape of the apertures for a particular coating composition must be determined empirically.

It will be understood that reducing the viscosity of the coating composition, for example, by using a conventional two coat composition instead of a one coat composition, will require the aperture area to decrease such the roller can be adequately loaded without the buoyant coating contacting member sinking.

It will also be appreciated that the total aperture area can be altered by increasing the number of apertures and/or increasing the average area of individual apertures. For example, for the same total aperture area, the buoyant coating contacting member would be more buoyant as the number of apertures increases, i.e. the apertures have a smaller area, but are greater in number.

The upthrust and the supply of coating composition to the roller is also influenced by the depth of the apertures and by the closeness of the fit of the buoyant coating contacting member in the container. Preferably, the apertures are from 0.5 to 2 mm deep and the average clearance between the buoyant coating contacting member and container is preferably from 1 to 4 mm near the top of the container reducing to a close fit at the base of the container if the container is tapered to facilitate its removal from a mould during its manufacture.

Another effective way to increase the upthrust on buoyant coating contacting member is to provide the perimeters of the buoyant coating contacting member with uprising walls akin to the hull of a boat. As in a boat, these walls increase the buoyancy of the buoyant coating contacting member allowing it to resist greater downwards pressure exerted by a user via the roller. The buoyant coating contacting member may, for example, have a pair of opposed perimeters provided with upwardly curving portions and the curvature may be chosen so as to match the curvature of the roller to facilitate uniform loading. Walls transverse to the curving perimeters need not be curved and may in fact be perpendicular to match the ends of the roller. Preferably, the walls rise to a height of from 15 to 30 mm above the underneath area of the buoyant coating contacting member. Transverse walls may be omitted if the perimeters from which they would rise make a close fit with the container.

It is preferred to provide the upper area of the buoyant coating contacting member with upstanding partitions surrounding the apertures so as to define local reservoirs into which paint can flow from the apertures to form local shallow pools. The partitions have top edges which are preferably located from 1 to 4 mm above the upper area of the buoyant coating contacting member so as to govern the depth of the pools. The disappearance of top edges below the surface of the paint can be employed to provide a user with an indication that the buoyant coating contacting member is becoming flooded with paint which is likely to overload the roller. When this happens, the user can simply reduce the downwards force on the roller allowing the hydraulic upthrust to raise the buoyant coating contacting member and lower the level of paint in the pools. Rolling the roller over such top surfaces also creates a more even loading of the roller. The buoyant coating contacting member can be made from any material that is buoyant in coating compositions but is preferably made from plastic having a density of below 1.0 kg/l and therefore polypropylene or low density polyethylene is especially suitable. The density of the plastic may be further reduced by using a foamed structure, but foaming is expensive for making thin profiles and it weakens it structurally. Also the buoyant coating contact member preferably is made from a material by itself or in conjunction with its shape, area of apertures, number and/or geometry of the apertures allows for re-floating. Re-floating would be a desirable feature to overcome instances where the member may become fully submersed in the coating such as from the accidental misapplication by the user of too strong a downward pressure on the floating buoyant coating contact member. The exertion of such an excessive downward pressure for too long a period of time and past the point of overloading the member might cause the member to sink in the fluid, gel or liquid coating below the coating surface and even deeper into the container and possibly to the bottom of the container. If the member does not absorb substantial amounts of the coating, the member can be re-floated just by lifting it to the surface of the coating with a suitable implement such as a screw driver or paint stirrer.

The container may be made from the same material as the buoyant coating contacting member and is preferably slightly tapered to facilitate its removal from a mould.

The ability of the coating composition to achieve one-coat cover is improved if the composition is given a gel-structure having a gel strength at 25° C. of above 90 g/cm and preferably from 100 to 150 g/cm. Gel structures are preferably imparted by including in the composition associative thickeners such as acrylamide/acrylic acid copolymers or poly (ethylene oxides). Alternatively, (as discussed in EP 0 144 135A mentioned earlier) water-swellable clays such as the laponites or bentonites or the titanium or zirconium chelates may be used.

The coating compositions may be aqueous paints comprising polymeric binder materials such as copolymers of methyl, ethyl, butyl or 2-ethyl hexyl acrylates or methacrylates optionally with acrylic or methacrylic acids or alternatively vinyl esters such as polymers of vinyl acetate optionally copolymerised with vinyl esters of long chain ($C_9$ to $C_{11}$) carboxylic acids. The compositions usually contain extenders and pigments such as clay or chalk or rutile which is both a white pigment and an opacifying pigment important to achieving one-coat cover. Optionally, and preferably for one-coat cover, the coating compositions contain from 20 to 35 (especially 25 to 28) wt % of rutile based on the total weight of the composition. In one embodiment of the present invention, the coating compositions can have a density at 25° C. of at least 1.45 kg/1, more suitably over 1.45 kg/1 and usually up to 1.8 kg/I, and most suitably in this embodiment 1.4 to 1.7 although up to 1.6 Kg/L is also suitable. For one-coat cover, it is preferred to apply the coating compositions to give a wet coat of thickness of from 60 to 160 (especially from 80 to 140) μm where 1 μm=$10^{-6}$m.

Measurement Procedures:

Measurement of Percentage Opacity: A rectangular white paper card chart 183 mm long by 172 mm wide was printed with a black band 183 mm long and 83 mm wide and which shared a longitudinal edge with the card. A wet coating 60 μm thick of the paint under test was applied across the card using a doctoring bar and then allowed to dry at 20 to 25° C. for 24 hours. The colour of the surface over the black band and the remainder of the white card were measured using a spectrophotometer and the percentage contrast ratio between the two colours was determined according to the procedure of British Standard 3900 Part D. This contrast ratio is presented in Table 1 as the percentage opacity. Total obliteration would give a 100% opacity but the market considers a 95% opacity to be adequate for one-coat cover.

Low Shear Viscosity: Low shear viscosity is measured at 25° C. using the Sheen "Rotothinner" and method as described in the brochure "Sheen/ICI Rotothinners" available from Sheen Instruments Limited of Teddington, England. High Shear Viscosity: High Shear Viscosity is measured at 25° C. using the ICI Cone and Plate Viscometer and method as described in ASTM Test D 4287-88.

Gel Strength: Gel Strength is measured at 25° C. using the Sheen Gel Strength Tester and method as described in the brochure "Ref 414 Gel Strength Tester" again available from Sheen Instruments Limited of Teddington, England.

FIG. 1 shows a one-coat coating combination according to this invention comprising lidable polypropylene tapered container 1 closed by polypropylene lid 2 and containing dense viscous paint 3 on which is disposed a substantially horizontal buoyant coating contacting member in the form of a polypropylene grid 4 (hereinafter referred to as "grid") having apertures 5 through which the liquid, gel or fluid, preferably liquid paint 3 can flow in response to a hydraulic pressure generated in reaction to a downwards force exerted on the grid 4.

In use, the downwards force is exerted by removing lid 2 and inserting roller 6 to a position shown in dashed lines in FIG. 1 and then pressing down on grid 4 via roller 6. The downwards force causes grid 4 to displace some of paint 3 driving it up through apertures 5 to form small local pools in square reservoirs 7 defined by 2 min high vertically upstanding partitions 8. Paint from reservoirs 7 can be loaded onto roller 6 by rolling roller 6 over the top edges 9 of partitions 8. For the purposes of clarity, the height of partitions 8 has been exaggerated in FIG. 1. Of course the partitions can be any series of ridges associated with one or more apertures to assist in having an appropriate amount of coating on a roller for use.

Figure 2:
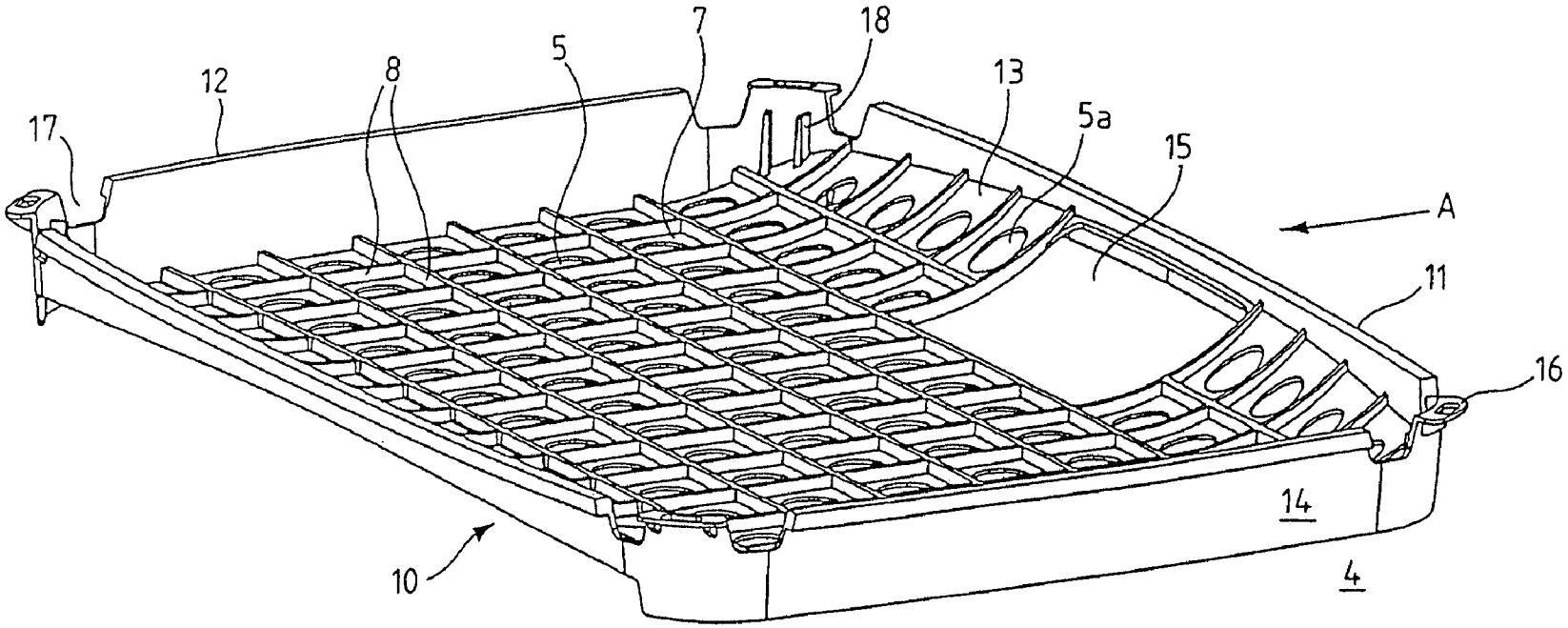
FIG. 2 is a perspective view on a larger scale of the buoyant coating contacting member shown in FIG. 1.
Figure 4:
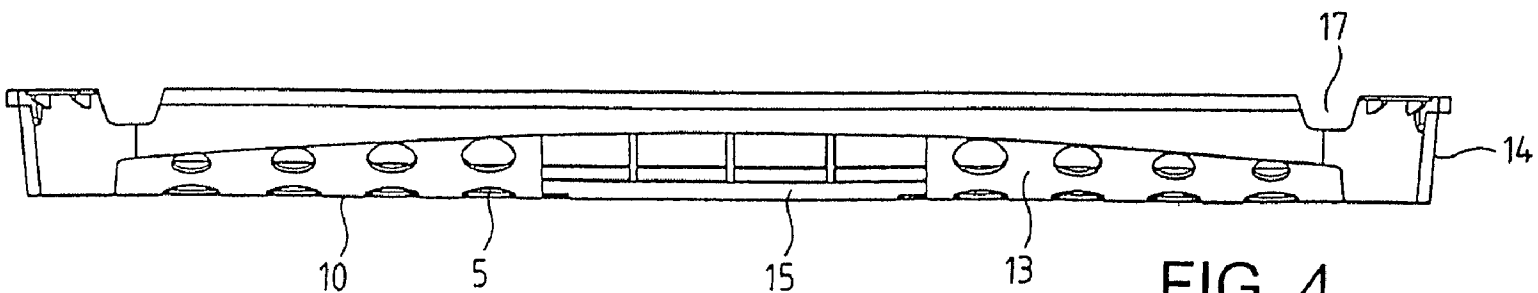
FIG. 4 is an end elevation of the buoyant coating contacting member shown in FIG. 2 seen in the direction of arrow A shown in FIG. 2.
Figure 3:
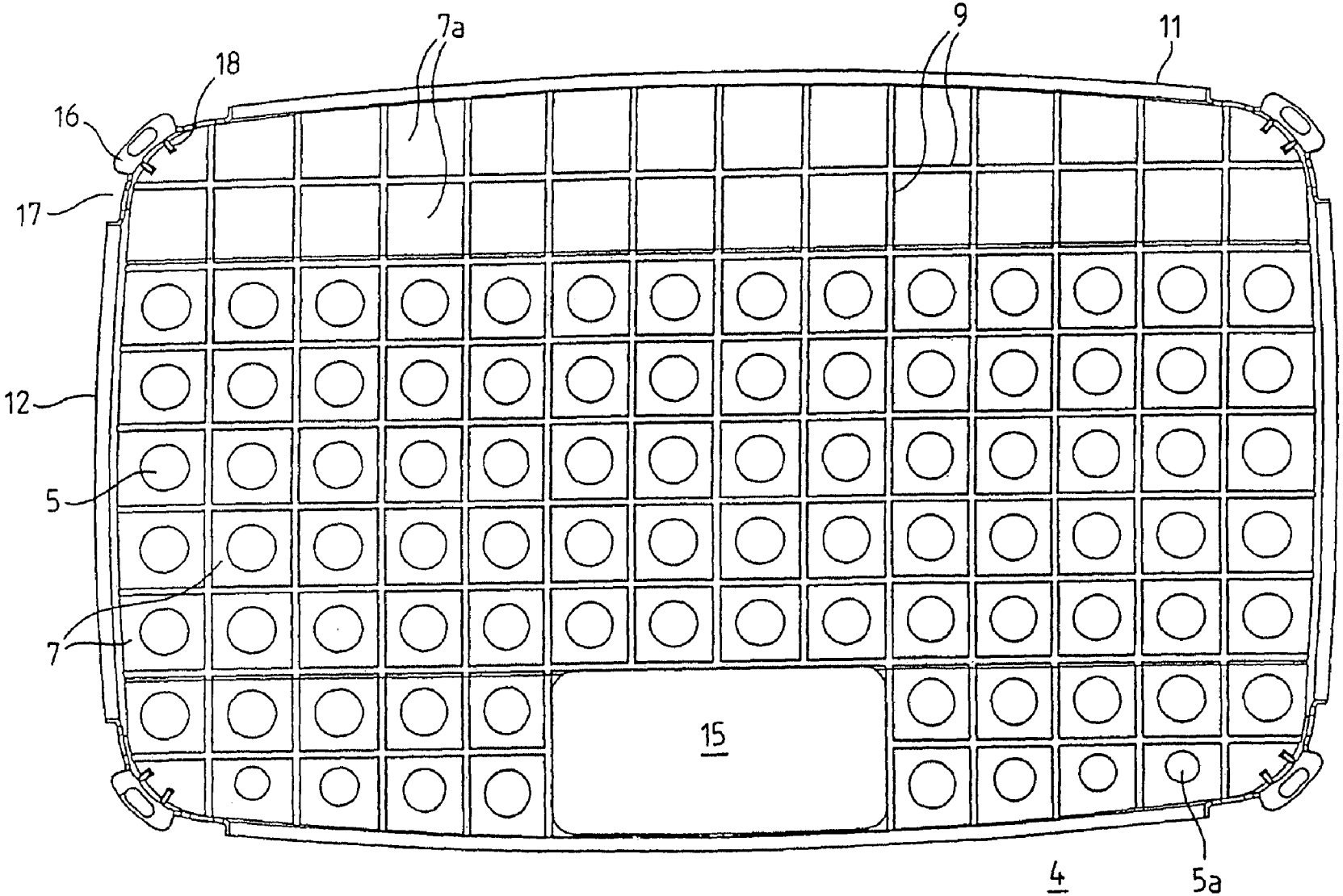
FIG. 3 is a plan view on a larger scale of the buoyant coating contacting member shown in FIG. 2.

FIGS. 2, 3 and 4 show grid 4 in greater detail from which it can be seen that grid 4 contains 88 circular apertures 5 leading from the underneath area 10 of grid 4 to reservoirs 7 defined by partitions 8. Except for 8 apertures 5*a* alongside perimeter 11, all apertures 5 have a radius of 5 mm, an area of 78.5 $mm^2$ and a depth of 1 mm. The radii of apertures 5*a* are tailored to accommodate the curvature of perimeter 11 of grid 4.

The height of partitions 8 limits the depth of the pools in reservoirs 7 which helps to control the amount of paint 3 being loaded onto roller 6. In particular, a DIY user can quickly see if top edges 9 of partitions 8 are about to be submerged by paint 3 in which case the user can immediately reduce the downwards pressure on grid 4 allowing it to rise and lower the level of paint 3 to below top edges 9.

The "underneath area" 10 of grid 4 is defined as the projection of grid 4 when horizontal onto a horizontal flat surface. it is in fact the area covered by the plan as shown in FIG. 3. The underneath area as represented by the plan shown in FIG. 3 has a maximum length of 265 mm and a maximum breadth of 170 mm giving an approximate underneath area 10 of 45 000 $mm^2$ of which 22% or about 10 000 $mm^2$ is occupied by apertures and about 78% or about 35 000 $mm^2$ is occupied by solid surface. This provides a large solid surface against which hydraulic pressure can react to create an upthrust which can balance the downwards force from roller 6 or which can raise grid 4 quickly in response to a reduction in that downwards force thereby helping to control the amount of paint 3 in reservoir 7 for loading onto roller 6.

Grid 4 has pairs of opposed perimeters 11 and 12. Perimeters 11 are each provided with upwardly curving marginal portions 13 and perimeters 12 are provided with almost perpendicular upstanding walls 14 so that portions 13 and walls 14 give grid 4 a shape similar in principle to that of the hull of a boat. This boat shape increases the amount of paint 3 which can be displaced by grid 4 and so increases the amount of hydraulic upthrust which can be generated giving several benefits. Firstly, it allows the roller to be pressed down harder onto the grid which in turn allows paint 3 to be delivered faster and in greater volumes through apertures 5 and so facilitates the loading of the roller. Secondly, a greater hydraulic upthrust on grid 4 increases its speed of response to a reduction in downwards force making it easier to control the loading of roller 6. The curvature of portions 13 matches the curvature of the circumference of roller 6 which helps to achieve more uniform distribution of paint 3 on roller 6.

The clearance between perimeters 11 and 12 and the walls 1*a* of container 1 is 1.5 mm when grid 4 is floating on the surface of paint in a full container and it reduces to a close fit when the container is empty. The viscous drag created as paint 3 is driven through the clearance helps in controlling the loading of the roller.

Two rows of reservoirs 7*a* are without apertures 5. This increases the total solid surface area available on the underneath area 10 of grid 4 for receiving the hydraulic upthrust and it also provides a capacity for receiving small amounts of excess paint 3 from roller 6. Grid 4 also contains an aperture 15 through which a brush can be inserted into the coating composition so as to permit brush-coating of areas inaccessible to roller 6.

Grid 4 is provided with flexible lugs 16 and rebates 17 to facilitate stacking during manufacture and prior to their disposition in container 1. They also have vertical strengthening ribs 18. Lugs 16 make an interference fit in a lower portion of the tapered container 1 so that as grid 4 descends, the walls of container 1 and lug 16 interact causing lugs 16 to flex and exert a resistance to the decent of grid 4 which helps to control the descent.

At no time in the coating process is there a need to remove grid 4 from container 1 and so it is virtually impossible to set it down in a position where its messiness would be a nuisance.

The invention is further illustrated by the following Examples of which Examples A to C are comparative.

EXAMPLES 1 TO 5 AND COMPARATIVE EXAMPLE A

A 4.5 liter container was filled at 18° C. with alternative paints (as specified in Table 1) to a depth of 120 mm and a grid as shown in FIGS. 1 to 4 was laid horizontally on the surface of the paint. At the level of the paint surface, the container had a maximum length of 268 mm and a maximum width of 173 mm which gave an average clearance of 1.5 mm between the perimeters of the grid and the walls of the container. The walls tapered inwardly so that at their base, the clearance reduced to zero. A lid was placed on the container for safe storage until the start of paint testing.

In Examples 1 to 3, three commercially available one-coat paints were tested for application by roller at 18° C. and in Examples 4 and 5, two popular paints of conventionally low viscosity were likewise tested. Example A employed a solid paint of the type described by EP 0 144 134A. Testing was performed by removing the lid and inserting a hand-held medium pile roller into the container and onto the grid. The roller had an axial length of 230 mm. The person holding the roller exerted a downwards force on it until pools of paint appeared in the reservoirs of the grid. The surface level of the pools was kept below the top edges of the partitions which define the extent of the reservoirs and then the roller was loaded with paint from the pools by rolling it back and forth twice over the top edges. The loaded roller was then used to apply paint to a rectangular board which was 900 mm long and 700 mm wide. The weight of paint applied to the board is shown in Table 1.

The opacity of the coatings was determined by applying paint to a test form according to the procedure described earlier and the percentage opacities are also shown in Table 1.

TABLE 1

| Eq | Density kg/l | Low Shear Viscosity Pascal · sec | High Shear Viscosity Pascal · sec | Gel Strength g · cm | Coating weight g | Opacity % |
|---|---|---|---|---|---|---|
| 1 | 1.55 | 2.9 | 0.23 | 132 | 113 | 95 |
| 2 | 1.61 | 1.5 | 0.20 | 72 | 130 | 95 |
| 3 | 1.55 | 1.4 | 0.18 | 41 | 121 | 95 |
| 4 | 1.27 | 1.3 | 0.14 | 50 | 76 | 91 |
| 5 | 1.32 | 0.8 | 0.11 | 75 | 77 | 91 |
| A | 1.42 | 0.5 | 0.09 | * | 100 | 91 |

*Too high to measure

It will be seen that the roller could be easily loaded with enough of the high density high viscosity one-coat paints of Examples 1 to 3 to achieve thick coatings of weights above 100 g and to achieve adequate opacities of 95%.

Attempts were also made to load the roller with enough of the one-coat paints of Examples 1 to 3 for one-coat cover by using a flat PVC grid having a structure open to the extent that 72% of its underneath surface was occupied by apertures. In all cases, light downwards force on the grid did not load the roller sufficiently for adequate one-coat cover and attempts to increase the force resulted in the grid submerging irretrievably and the roller overloading with no means of removing the excess paint.

Whilst the above embodiment describes the invention in relation to the application of one-coat coating compositions, the increased speed and control of roller loading obtainable using the grid is also of value in applying conventional (less viscous) coating compositions.

By varying one or more of the physical properties of the grid, i.e. the shape, density, total aperture area, and number of apertures, and/or altering the clearance between the grid and the container, it is possible to use the grid with coating compositions having a low shear viscosity from 0.05 to 3.5 Pa·s as in Examples 4 and 5 such that the roller can be adequately loaded without the grid sinking totally below the surface of the liquid or fluid coating composition in the container.

The invention claimed is:

1. A coating combination suitable for use in coating architectural surfaces which comprises in combination a liddable container for a coating composition, a coating composition provided within the liddable container, wherein the coating composition has a high shear viscosity at 25° C. of at least 0.01 pascal.sec and a low shear viscosity at 25° C. of from 0.05 to 3.5 pascal.sec and a plastic buoyant coating contacting member (4) having an underneath area and consisting essentially polyethylene or polypropylene member having a density of less than 1.0 Kg/L, including at least one aperture disposed substantially horizontally within the liddable container, wherein the total aperture area is 70% or less of the underneath area of the buoyant coating contacting member and has physical properties such that the buoyant coating contacting member is buoyant on the coating composition and submersible within the coating composition to the extent that under a downwards force from a coating applicator, a portion of the coating composition is allowed to flow through the at least one aperture such that the coating applicator can pick up the coating composition, in which the physical properties of the buoyant coating contacting member enables it to experience a hydraulic upthrust which is greater than the hydraulic upthrust which would be experienced by a notional planar buoyant coating contacting member made of same material when under the same downwards pressure and having the same horizontal dimensions as the buoyant coating contacting member but having an average thickness of 1 mm, so that a coating applicator can be loaded sufficiently to provide a one-coat covering when the covering is applied to a surface.

2. A coating combination according to claim 1 wherein the coating composition has a high shear viscosity at 25° C. of from 0.1 to 0.3 pascal.sec, and a low shear viscosity at 25° C. of from 0.05 to 3.5 pascal.sec.

3. A coating combination according to claim 1 in which coating composition has a high shear viscosity at 25° C. of from 0.17 to 0.25 pascal.sec and a low shear viscosity at 25° C. of from 0.3 to 3.5 pascal-seconds.

4. A coating combination according to claim 1 in which the coating composition has a high shear viscosity at 25° C. of from 0.15 to 0.3 pascal.sec and a low shear viscosity at 25° C. of from 0.08 to 3.5 pascal.sec.

5. A coating combination according to claim 1 in which the coating composition has a density at 25° C. of from 1.4 to 1.8 Kg/L, preferably from 1.45 to 1.6 Kg/L.

6. A coating combination according to claim 5 in which the coating composition has a density of at least 1.45 kg/I.

7. A coating combination according to claim 1, wherein the coating composition has a high shear viscosity at 25° C. within the range from 0.2 to 2 Pascal-seconds while also having a low shear viscosity within the range of 0.05 to 3.5 Pascal-seconds.

8. A coating combination according to claim 1, wherein the coating composition has a high shear viscosity within the range from 0.5 to 1.5 Pascal-seconds.

9. A coating combination according to claim 1 wherein the container has a lid.

10. A coating combination according to claim 1 in which the buoyant coating contacting member contains apertures (5) which cover less than 60%, of the underneath area (10) of the buoyant coating contacting member.

11. A coating combination according to claim 1 in which the buoyant coating contacting member contains apertures (5) which cover less than 40% of the underneath area (10) of the buoyant coating contacting member.

12. A coating combination according to claim 1 in which the coating composition has a high shear viscosity at 25° C. within the range from 0.2 to 2 Pascal-seconds while also having a low shear viscosity within the range of 0.05 to 3.5 Pascal-seconds and the buoyant coating contacting member contains apertures (5) which cover less than 1.0% of the underneath area (10) of the buoyant coating contacting member.

13. A coating combination, according to claim 1 in which the buoyant coating contacting member has opposed perimeters (11) provided with upwardly curving portions (13).

14. A coating combination according to claim 1 in which the buoyant coating contacting member has opposed perimeters (12) provided with vertically upstanding walls (14).

15. A coating combination according to claim 1 in which the buoyant coating contacting member has apertures (5) surrounded by partitions (8) which define reservoirs (7).

16. A coating combination according to claim 1 in which the buoyant coating contacting member includes at least one flexible lug which is arranged such that, when the buoyant coating contacting member is under a downwards pressure from the coating applicator, the walls of the container and the at least one flexible lug interact so as to exert a resistance to the descent of the buoyant coating contacting member.

17. A coating combination according to claim 16 in which the buoyant coating contacting member has four corners and includes four flexible lugs (16), each of the four flexible lugs being located at each corner of the buoyant coating contacting Member.

18. A coating combination claim 1 in which the walls of the container are downwardly tapered such that the resistance to the descent of the buoyant coating contacting member increases as it descends.

19. A coating combination according to claim 1 in which the buoyant coating contacting member is a grid, and the at least one aperture is defined by the grid.

20. A buoyant coating contacting member (4) including at least one aperture for disposition substantially horizontally within a lidable container containing a coating composition, wherein the total aperture area is less than 70% of the underneath area of the buoyant coating contacting member consists essentially of a polyethylene or polypropylene member having an underneath area and a density of less than 1.0 Kg/L, physical properties such that the buoyant coating contacting member is buoyant on the coating composition when lying substantially horizontal, and submersible within the coating composition to the extent that under a downwards force from a coating applicator, wherein the member has physical properties that provide for the member to have a hydraulic upthrust which is greater than the hydraulic upthrust which would be experienced by a notional planar buoyant coating contacting member made of the same material when under, the same downwards pressure and having the same horizontal dimensions as the buoyant coating contacting member but having an average thickness of 1 mm and a portion of the coating composition is allowed to flow through the at least one aperture such that the coating applicator can pick up the coating composition, so that a coating applicator can be loaded sufficiently to provide a one-coat covering when the covering is applied to a surface.

21. The buoyant coating contacting member according to claim 20 in which the buoyant coating contacting member contains apertures (5) which cover less than 60%, of the underneath area (10) of the buoyant coating contacting member.

22. The buoyant coating contacting member according to claim 20, in which the buoyant coating contacting member contains apertures (5) which cover less than 40% of the underneath area (10) of the buoyant coating contacting member.

23. The buoyant coating contacting member according to claim 20 in which the buoyant coating contacting member has opposed perimeters (11) provided with upwardly curving portions (13).

24. The buoyant coating contacting member according to claim 20 in which the buoyant coating contacting member has opposed perimeters (12) provided with vertically upstanding walls (14).

25. The buoyant coating contacting member according to claim 20 in which the buoyant coating contacting member has apertures (5) surrounded by partitions (8) which define reservoirs (7).

26. The buoyant coating contacting member according to claim 20 in which the buoyant coating contacting member includes at least one flexible lug which is arranged such that, when the buoyant coating contacting member is under a downwards pressure from the coating applicator, the walls of the container and the at least one flexible lug interact so as to exert a resistance to the descent of the buoyant coating contacting member.

* * * * *